US005657556A

United States Patent [19]

Bemis

[11] Patent Number: 5,657,556

[45] Date of Patent: Aug. 19, 1997

[54] FOOTWEAR SOLE COMPONENT AND PRODUCTION METHOD

[75] Inventor: Jon L. Bemis, Jakarta Selatan, Indonesia

[73] Assignee: L.A. Gear, Inc., Santa Monica, Calif.

[21] Appl. No.: 747,212

[22] Filed: Nov. 12, 1996

Related U.S. Application Data

[63] Continuation of Ser. No. 353,028, Dec. 8, 1994, abandoned.

[51] Int. Cl.[6] ..... A43C 15/02

[52] U.S. Cl. ..... 36/30 R; 36/59 A; 36/59 R; 12/142 P

[58] Field of Search ..... 36/103, 30 R, 36/30 A, 31, 59 R, 59 A, 59 B, 59 C, 134, 62, 64, 65, 66, 67 D, 67 R, 7.6; 12/142 P

[56] References Cited

U.S. PATENT DOCUMENTS

| | | | |
|---|---|---|---|
| 1,232,518 | 7/1917 | Emery | 36/59 R |
| 2,192,150 | 2/1940 | Pierce et al. | 36/2.5 |
| 3,355,823 | 12/1967 | Vogt | 36/7.6 |
| 3,410,005 | 11/1968 | Szerenyi | 36/2.5 |
| 3,413,737 | 12/1968 | Kneebusch | 36/67 |
| 3,484,957 | 12/1969 | Druilhet | 36/2.5 |
| 3,487,563 | 1/1970 | Austin | 36/67 |
| 3,526,976 | 9/1970 | Jacobs | 36/2.5 |
| 3,672,077 | 6/1972 | Coles | 36/2.5 T |
| 3,878,626 | 4/1975 | Isman | 36/15 |
| 4,035,934 | 7/1977 | Hrivnak | 36/67 D |
| 4,178,702 | 12/1979 | Mayer | 36/59 R |
| 4,317,294 | 3/1982 | Goodyear | 36/100 |
| 4,357,763 | 11/1982 | Fletschmann et al. | 36/67 D |
| 4,366,632 | 1/1983 | Bente | 36/67 D |
| 4,380,878 | 4/1983 | Skaja | 36/67 D |
| 4,523,396 | 6/1985 | Dassler | 36/134 |
| 4,674,207 | 6/1987 | Yamaguchi | 36/126 |
| 4,676,010 | 6/1987 | Cheskin | 36/59 A X |
| 4,698,924 | 10/1987 | Greiner et al. | 36/134 |
| 4,837,960 | 6/1989 | Skaja | 40/636 |
| 5,282,288 | 2/1994 | Henson | 12/142 P |
| 5,317,822 | 6/1994 | Johnson | 36/101 |
| 5,331,753 | 7/1994 | Rodibaugh | 36/136 |
| 5,361,518 | 11/1994 | Sussmann et al. | 36/134 |
| 5,367,791 | 11/1994 | Gross et al. | 36/30 A |

FOREIGN PATENT DOCUMENTS

| | | | |
|---|---|---|---|
| 0749468 | 7/1933 | France | 36/59 A |
| 2199232 | 7/1988 | United Kingdom | 36/134 |
| 9218027 | 10/1992 | WIPO | 36/134 |

*Primary Examiner*—Ted Kavanaugh
*Attorney, Agent, or Firm*—Don C. Lawrence

[57] ABSTRACT

Lightweight, inexpensive footwear sole components (14, 18), comprising a midsole portion (14) and an outsole portion (18), are formed by a method that eliminates the need for adhesively attaching the two portions to each other, and comprises the steps of 1) Forming the midsole portion (14) to have a lower surface (17) and at least one opening (26) extending into it through the lower surface (17); 2) Forming the outsole portion (18) on the lower surface (17) of the midsole portion (14) such that the outsole portion has an upper part (28) extending into the opening (26) in the midsole portion; and, 3) Forming a mechanical attachment device (22) between the outsole portion (18) and the midsole portion (14) on an upper end (19) of the outsole portion (18).

9 Claims, 4 Drawing Sheets

FOOTWEAR SOLE COMPONENT AND PRODUCTION METHOD

This is a continuation of application(s) Ser. No. 08/353,028 filed on Dec. 8, 1994 now abandoned.

BACKGROUND OF THE INVENTION

1. Field of the Invention

This invention pertains to footwear in general, and in particular, to simplified, lightweight sole components for shoes and boots, and the methods by which they can be produced.

2. Description of the Related Art

Modern athletic and casual footwear typically incorporate some form of a resilient, composite sole component that is designed to achieve a balance, or compromise, between performance, comfort, looks and wear. Such sole components often include a foamed elastomeric midsole, which is typically made of a relatively low-durometer, thermoformed ethylene vinyl acetate ("EVA") plastic, or an injection-molded, foamed polyurethane ("PU") plastic material, or less frequently, a solid or foamed rubber elastomer, e.g., Neoprene. A recent patent that describes a method for making such a midsole of a particular composition of EVA material is described in U.S. Pat. No. 5,177,824 to Y. Ou.

Midsoles made of foamed EVA, PU, or rubber exhibit very good resilience and shock absorption properties, particularly in view of their relatively low weight and manufacturing costs. Also, they can be molded to include very intricate aesthetic and functional details, and will accept coloring fairly well by means of dyes, pits, additives and the like. However, one of their shortcomings is a poor resistance to wear, and particularly, a poor resistance to abrasion. Another drawback relates to their potentially poor coefficient of friction with certain types of surfaces, particularly after heavy wear, and the resulting loss of traction.

For these reasons, modern casual and athletic sole components usually also incorporate an outsole component molded of a solid, relatively high-durometer, resilient elastomer, typically, natural rubber ("NR") or man-made rubbers, such as butadiene ("BR"), styrene butadiene ("SBR"), or isoprene ("IR"), or combinations of these. These are typically laminated, or bonded, to the underside of the midsole by means of a flexible adhesive, as described below, and result in superior wear resistance and traction properties for the footwear.

It is known in the art, in a process called "direct attachment," to form either a PU midsole component or a PU outsole component in a first mold set, then to place the molded component into a second mold set and inject or pour the complementary sole component directly onto the first-molded component, such that the two components are chemically joined to one other after final curing. The resulting sole component is known as a "unit bottom," and the attachment between the outsole and midsole portions is very strong, since the respective molecules of the two portions are actually cross-polymerized, or linked, to each other. However, the method is limited to midsole and outsole components that are each made of a chemically similar material, namely, PU, and it is necessary to implement the second injection or pour step fairly quickly after the first-molded component is formed and before it is fully "cured," or polymerized.

However, midsole and outsole components are usually dissimilar in their materials, as described above. It is therefore typical to mold them in separate mold sets, then assemble them together adhesively, sometimes together with other sole or upper components, in a manual bonding, or adhesive, process wherein the cleanliness, "roughness," registration, and adhesive coverage of the two components, together with a strict control over the process temperature, are critical to an effective joining of the various parts. In U.S. Pat. No. 5,131,173, W. Anderié describes a sole component in which a relatively hard "carrier," or shank element, is adhesively interposed between an outsole component and a resilient midsole component for enhanced foot support in the finished shoe.

While it is possible to coat a first-molded sole component with a compatible adhesive, then inject the complementary sole component onto the adhesive layer in a second mold such that two parts are adhesively joined upon final cure of the second-molded component, little economy or efficiency is gained thereby, since the same strict control over the adhesive part of the operation must be maintained to ensure a reliable attachment of the components to each other. Therefore, it would be desirable if the adhesive, or bonding, operation could be eliminated entirely, particularly in the case of sole components of dissimilar materials, in favor of an outsole-to-midsole attachment process that is simpler, less costly, yet just as reliable.

Another problem indirectly associated with footwear sole component bonding methods is their finished weight. It is known that the wear experienced on an outsole component during normal wear of the shoe is restricted to certain areas on the underside of the sole. Because outsole materials are typically denser, and thus, heavier, than typical midsole component materials, it is at least theoretically possible to eliminate an appreciable portion of the overall weight of a sole component by confining the areal extent of the outsole to those regions of high wear, in a design that incorporates one or more distinct, unconnected "wear plugs," or discrete outsole components, and that leaves the underside of the midsole component exposed in areas of little or no wear. However, this theoretical design is seldom observed in conventional sole component construction because it effectively substitutes a plurality of adhesive bonds for what was previously a single bond joint, thus compounding the problems described above. Additionally, the individual wear-plug-to-midsole bond area is considerably reduced, relative to that of a design that incorporates coextensive midsole and outsole component surface attachment areas, thus reducing the effective tear strength of the individual wear plug.

Accordingly, sole components today, whether made by "direct attachment" or conventional lamination techniques, typically incorporate a design in which the outsole component covers substantially the entire bottom surface of the midsole, and wherein distinct wear plugs are interconnected by means of a common base, or "web," which provides a single, large-area surface that is attached to the bottom surface of the midsole component. While this design results in some benefits in production costs, namely, a simplified, "single-component" to "single-component" attachment, the countervailing penalty is additional material costs, and particularly, added weight, as the webbing typically accounts for about 50% of an outsole component's volume and weight. Again, since this web structure is only present to address the attachment problems described above, it is desirable to provide a method for reliably attaching discrete wear plug components to a midsole component that avoids the above attachment problems, including the need for this web structure.

The present invention relates to methods for producing footwear sole components in which one or more outsole components, or wear plugs, are reliably attached to at least one midsole component without the attendant material, structural, cost, and weight limitations of the direct attachment, or adhesive attachment, methods described above. The method results in sole components that are lightweight, reliably attached to each other, and yet relatively simple and inexpensive to make.

SUMMARY OF THE INVENTION

The first preferred embodiment of the method of the present invention comprises the step of forming, in a first mold, a midsole portion having an upper, footbed-defining surface, a lower, ground-directed surface, at least one opening, preferably a through-opening, extending into it through the lower surface, and a countersink formed at an upper end of the opening, preferably in the upper surface of the midsole portion.

The midsole portion is then placed into a second mold, wherein an outsole potion is formed onto the lower surface of the midsole portion such that the outsole potion has a lower part defining a ground-contacting wear-boss depending from it, and an upper part extending into the opening in the midsole portion. A head, like that on a rivet, is formed within the countersink on the upper end of the upper part of the outsole portion such that the midsole portion is gripped closely between the rivet head and the lower body of the outsole potion, thereby forming a strong mechanical connection between the two, without the use of adhesives or molecular cross-linking.

In the first preferred embodiment, the midsole portion is preferably compressed slightly within the second mold during the formation of the outsole portion such that, when the finished sole component is removed from the mold, the midsole potion expands slightly, thereby placing the upper part of the outsole potion in tension, and causing the midsole potion to grip the upper part and rivet head of the outsole portion more tightly. Also, in the first preferred embodiment, an outsole-potion-receiving recess is preferably molded into the lower, ground-directed surface of the midsole potion such that, when the outsole portion is attached to the midsole portion, an upper surface of the lower part of the outsole portion is recessed above the lower surface of the midsole portion, thereby reducing the likelihood that, during wear of the shoe, a sharp object might enter between the midsole portion and the outsole portion and thereby initiate a sheafing tear of the upper part of the outsole portion.

In a second preferred embodiment of the method, the outsole portion is formed in a first mold to include an upper surface and the upper portion and head features described above, and then placed into a second mold, wherein the midsole portion is then formed onto the upper surface of the outsole portion to surround, and interlock with, the head and upper portion of the outsole portion.

In yet another preferred embodiment, the outsole portion is formed in a first mold to include an upper part, but without a head on it, and the midsole portion is formed in a second mold. The two parts are then assembled together manually, and a head is formed onto the upper part of the outsole portion, either by a molding step implemented in a third mold, or alternatively, by mechanical means, in a head-attaching step that can be accomplished in several known ways.

A better understanding of the methods of this invention, along with their many attendant advantages, may be had from a consideration of the detailed description of the preferred embodiments, found hereinafter, particularly if this description is considered in conjunction with the figures of the accompanying drawings. A brief description of these drawings now follows.

DETAILED DESCRIPTION OF THE PREFERRED EMBODIMENTS

In the following description of the preferred embodiments of the present invention, like reference numbers refer to like components. It should be understood that the following is a description of the presently preferred embodiments of the present invention, but that the invention is in no way limited to those embodiments discussed hereinbelow or illustrated in the accompanying drawings.

Figure 1:
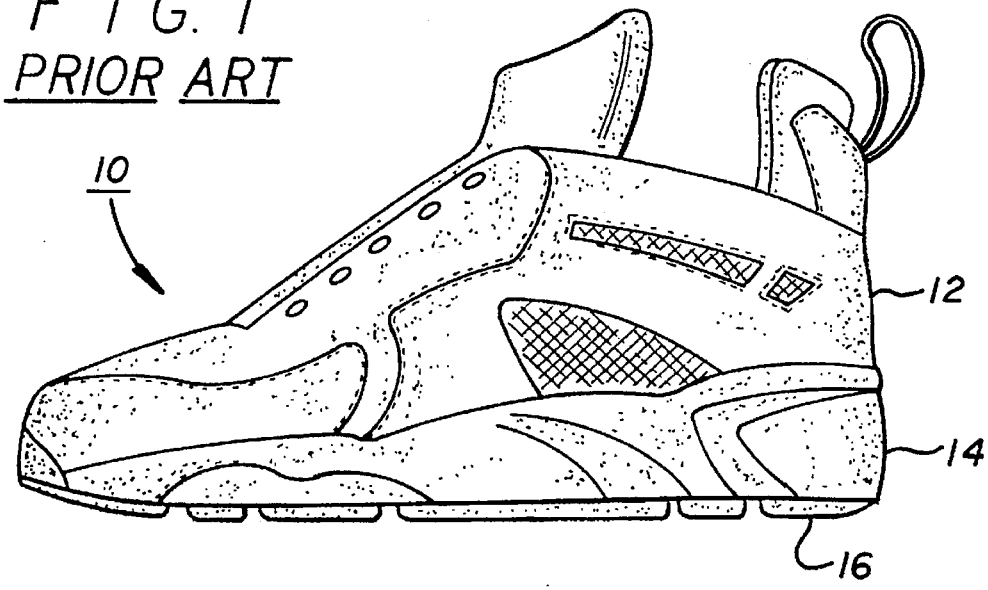
FIG. 1 PRIOR ART
FIG. 1 is a side elevational view of a typical, prior art casual or athletic shoe of the type to which the present invention is especially well adapted.
Figure 3:
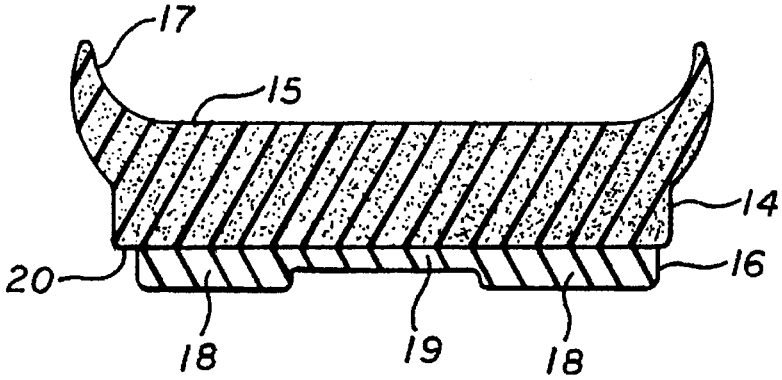
FIG. 3 PRIOR ART
FIG. 3 is a sectional view through the midsole and outsole portions of the shoe of FIG. 1, as revealed by the section 3—3 taken in FIG. 2.
Figure 2:
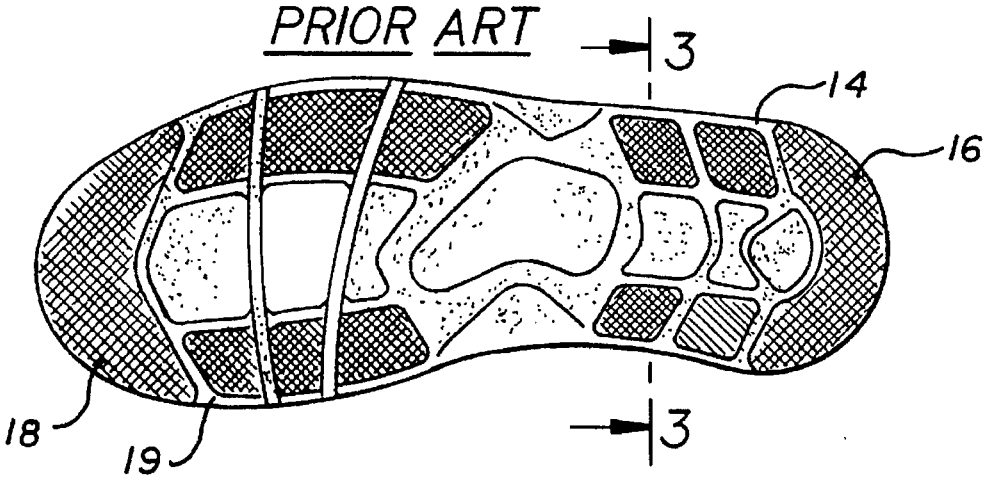
FIG. 2 PRIOR ART
FIG. 2 is a bottom plan view of the shoe of FIG. 1, showing the lower, or ground-contacting surface of the outsole of the shoe, and wherein a section is taken along the line 3—3.
Figure 4:
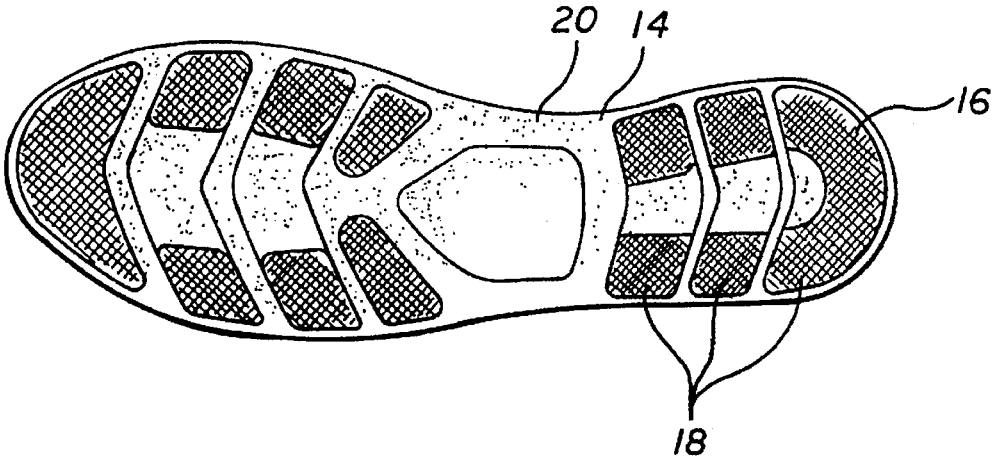
FIG. 4 is a bottom plan view of a sole component of the present invention, showing the lower, ground-contacting surface thereof, including a plurality of distinct outsole portions, or wear bosses, formed thereon.

Although the present invention has application to a wide variety of footwear, it is particularly well suited to casual and athletic footwear, such as the sports shoe 10 illustrated FIGS. 1–3. FIG. 1 is a lateral side elevational view of the sports shoe 10, which typically includes an upper 12, and a sole composite, typically comprising a midsole 14 and an outsole 16. The upper may be comprised of a number of different types of sheet materials, such as nylon, leather, plastic-coated leather, suede, denim fabric, or other suitable materials, depending on the particular type of activity in which the shoe will be worn and its desired cosmetic appearance. These materials are typically die-cut and stitched together over a foot-shaped form called a "last."

As described above, the midsole 14 material typically comprises a foamed EVA, PU or rubber material that exhibits the resilience and shock absorption characteristics desired. Preferably, the midsole material comprises foamed EVA. Also, as described above, the outsole 16 is typically formed of materials that have much better abrasion and wear characteristics than foamed EVA. In the preferred embodiment, the outsole material comprises a rubber material, either natural, man-made, or a mixture of both.

In the bottom plan view of the prior art sports shoe 10 seen in FIG. 2, the bottom surface 20 of the midsole 14 is typically protected from contact with the ground surface by the outsole element 16. The outsole element typically comprises a thin "web" structure 19 (FIG. 3), which, as described above, completely underlies the lower surface 20 of the midsole 14, is typically adhesively bonded directly to that surface, and includes a plurality of downwardly-depending, integrally-molded wear bosses 18 molded onto it.

The midsole 14 may be formed in a number of shapes, but, in modern footwear, is typically formed in a "cupsole" configuration, such that the upper, footbed-defining surface 15 of the midsole 14 includes a pair of lateral side walls 17 that curve gradually upward from the footbed-defining surface 15. In the cross-sectional view seen in FIG. 3, the lateral side walls 17 form a cup-shaped structure. The lateral side walls 17 serve to support the wearer's foot and provide a surface on which to apply an adhesive bonding agent for bonding the midsole 14 to the upper 12. As is known in the art, the midsole 14 can be attached to the upper 12 through an adhesive bond, through a stitching process using a suitable thread material, or through a combination of adhesive bonding and stitching.

In a preferred embodiment of the present invention, referring to FIGS. 4–7, the outsole 16 may be comprised of a plurality of outsole portions, or wear bosses 18, each of which is independently connected with the midsole 14, thereby eliminating the interconnecting web structure 19 of the prior art footwear. The wear bosses 18 each make contact with the ground and are formed of a typical outsole material such as those discussed above. The lower surface 20 of the midsole 14 is thus exposed between the wear bosses 18, but the wear bosses protrude a sufficient distance from the midsole 14 such that the exposed lower surface of the midsole 20 does not make contact with the ground surface, thereby avoiding unnecessary wear of the midsole.

Figure 5:
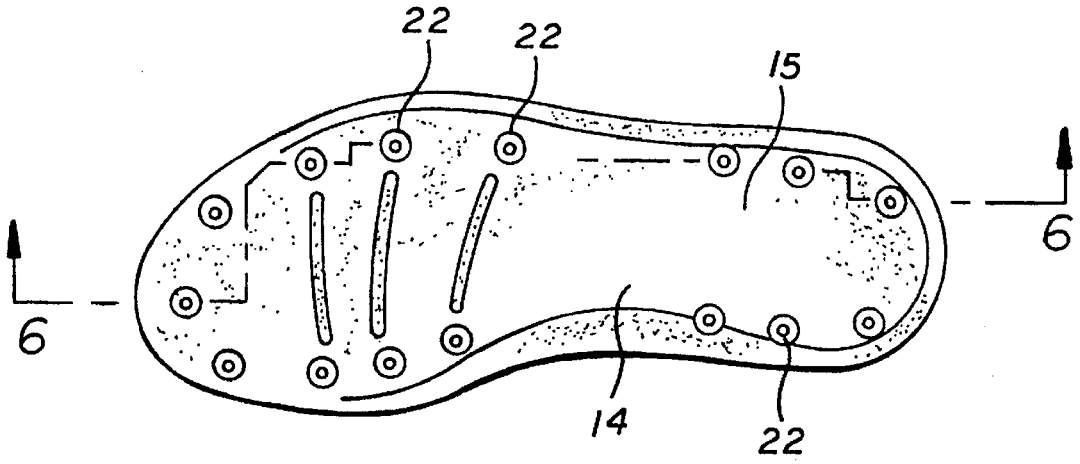
FIG. 5 is a top plan view of the sole component seen in FIG. 4, and wherein a section is taken along the line 6—6.
Figure 6:
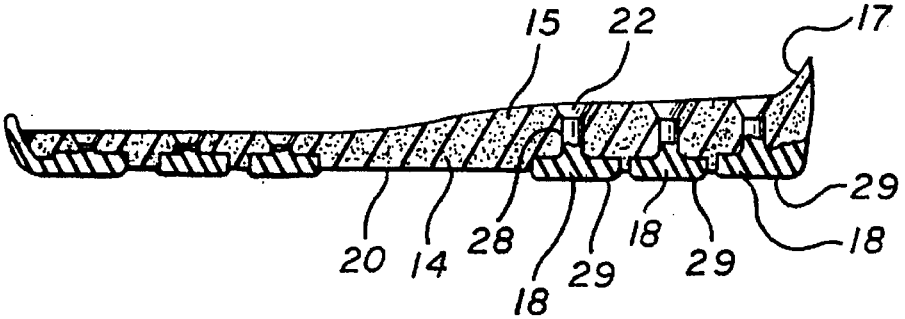
FIG. 6 is a sectional view through the sole component of FIG. 4, as revealed by the section 6—6 taken in FIG. 5, showing in cross section the details of the midsole portion and distinct wear bosses comprising the outsole portion of the sole component.

Referring more specifically to FIGS. 5 and 6, the individual wear bosses 18 are formed to include a rivet-like structure, comprising a rivet head 21 having a substantially flat, table-like upper surface formed to be flush with, or slightly recessed below, the upper surface 15 of the midsole 14. The rivet heads 22 are connected via a shaft 28 with a lower support member 29.

Figure 8:
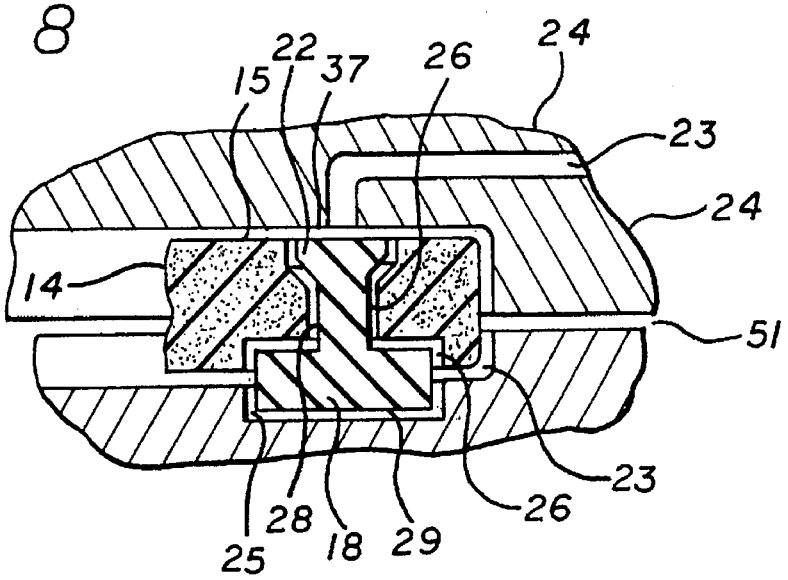
FIG. 8 is a partial cross section taken through a mold, showing the formation therein of the wear boss seen in FIG. 7 onto its associated midsole portion, in accordance with the method of the present invention.
Figure 9:
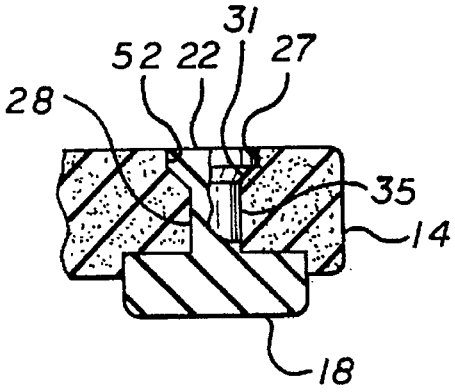
FIG. 9 is a partial cross-sectional view through the wear boss and associated midsole component seen in FIGS. 7 and 8, showing their engagement with one another after their removal from the mold.
Figure 7:
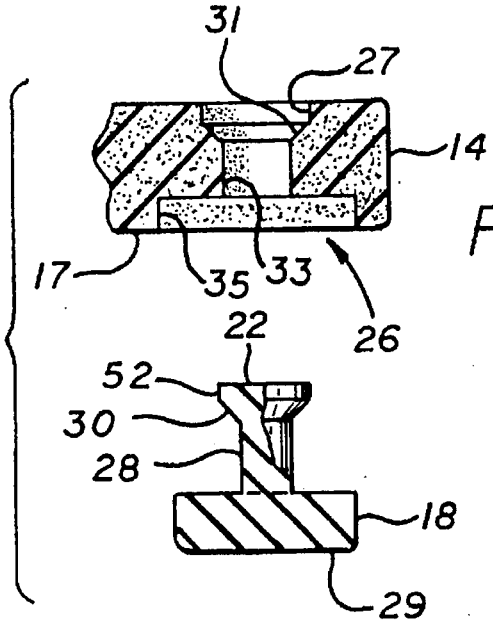
FIG. 7 is a partial cross-sectional view similar to that seen in FIG. 6, except taken through a single wear boss and its associated midsole portion, and wherein the wear boss and associated midsole component are shown exploded apart.

As seen in more detail in FIGS. 7–9, the wear bosses 18 include a chamfered surface 30 between the rivet head 22 and the shaft 28. The shaft 28, which is preferably cylindrically shaped, but which may take any desired cross-sectional shape, is integrally formed with the rivet head 22 and the lower support member 29. The support member 29 is exposed on the bottom of the shoe, and supports the shoe on the ground such that the midsole 14 does not contact the ground surface. As can be seen in FIG. 7, the midsole 14 is formed to include through openings 26 therein.

Figure 10:
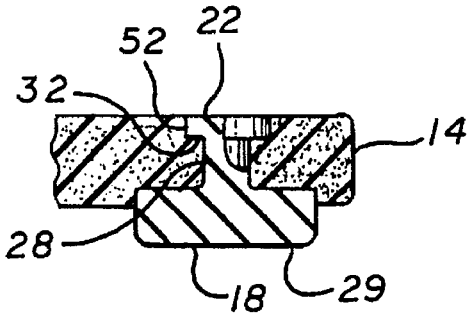
FIG. 10 is a partial cross-sectional view through a wear boss and its associated midsole component similar to those seen in FIGS. 7, 8, and 9, but showing a slightly modified detail of the rivet head on the wear boss.

The openings 26 include wall surfaces 27, 31, 33 and 35 that accommodate the rivet head rim 52, chamfered surface 30, shaft 18 and lower support member 29 of a boss 18, respectively. The rivet head 22 is recessed into the cavity 26 to be flush with, or recessed slightly below, the upper surface 15 of the midsole 14, while the lower support member 29 is recessed, or countersunk, into the lower surface 17 of the midsole 14, but is sized to protrude below the lower surface 20 of the midsole 14, as seen in FIG. 9. As seen in FIG. 10, the rivet head 22 may be formed in a cylindrical shape having a flat lower surface 32 which overhangs, and extends circumferentially about, the shaft 28.

Referring to FIG. 8, the formation of a sole employing the sole components of the present invention is illustrated. The midsole 14 is formed in a separate mold (not shown), using known methods, such as pour-molding, injection molding, or thermoforming, to include the through opening 26. The molded midsole 14 is then placed in a two-piece mold 24. Pressure is then applied by the mold 24 sufficient to slightly compress the midsole 14. Liquid or molten outsole material, such as a rubber, or polyisocyanate resin, mixed together with a polyhydroxyl hardener, is injected into the mold 24 through a channel, or "gate" 23, which aligns with the opening 26. A sufficient amount of outsole material is injected to completely fill the opening 26, together with the balance of the void between the midsole 14 and the lower half of the mold 24. To shape the support member 29, the lower half of the mold 24 includes a recess 25, which is also filled by the injected outsole material. In effect, the pre-molded midsole 14 is being used to partially define the mold of the bosses 18. The flat upper surface of the rivet head 22 is formed by the substantially flat surface 37 of the mold 24, which abuts the upper surface 15 of the midsole 14. Any "flash," or excess outsole material extending above the plane of the upper surface 15 of the midsole 14 can easily be removed by a heat knife, sanding, or any other suitable finishing process.

After injection, the outsole material is allowed to cure briefly in the mold 24. After a sufficient time to allow the outsole material to cure, the compression pressure placed on the midsole 14 by the mold 24 is released. The release of the compression pressure allows the foamed material of the midsole 14 to expand slightly. This expansion of the midsole 14 produces a compressive force that is applied to the rivet head 22 and lower support member 29 of the boss 18. The compressive force thus helps to secure the boss 18 in the midsole 14 under tension from the foamed midsole material. Referring back to FIG. 5, in the preferred embodiment of the present invention, a plurality of bosses 18 are formed simultaneously in mold 24. Thus, at the end of the curing process, the midsole 14 includes a plurality of separately formed bosses 18 that are mechanically secured to it, without the use of adhesive attachment.

By forming the individual wear bosses 18 at selected, high-wear zones of the midsole 14, the need for an adhesive bond between the outsole and the midsole is eliminated. Specifically, the connection between the outsole wear bosses 18 and the midsole material through the agency of the rivet structure is sufficient to prevent the entry of debris between the bosses 18 and the foamed material of the midsole 14. The secure fit between the bosses 18 and the midsole 14 is achieved, in part, due to the compression of the midsole 14 during the formation of the bosses 18, the subsequent expansion of the midsole 14 after the pressure thereon is removed by the mold 24, and, as described below, a slight shrinkage of the rivet structure of the bosses during cure. Referring more specifically to FIG. 8, it is seen that there is a gap, or recess 51, between upper and lower surfaces of the mold 24. The gap 51, when dosed, represents an amount of compression of the midsole material 14 during injection and cure of the bosses. The mold 24 is formed with sufficient space 13 about the midsole material 14 to allow for horizontal expansion of the midsole 14 upon compression thereof by the mold 24.

In addition to the bias pressure exerted on the opposite ends of bosses 18 caused by the expansion of the midsole material 14 upon release of the compression pressure by the mold 24, those skilled in the art will appreciate that the bosses 18 will shrink slightly in size as the outsole material cures in the mold. As the rivet structures of the bosses 18 contract, they exert a compressive force on the upper and lower surfaces 15, 20 of the midsole material 14. The expansion of the midsole 14, coupled with the slight contraction of the bosses 18, produces a tight, secure fit between the outsole and midsole materials sufficient to secure the bosses 18 to the midsole 14 and to eliminate any excess space between the bosses 18 and the midsole 14 that would allow debris to collect between the two materials.

Figure 11:
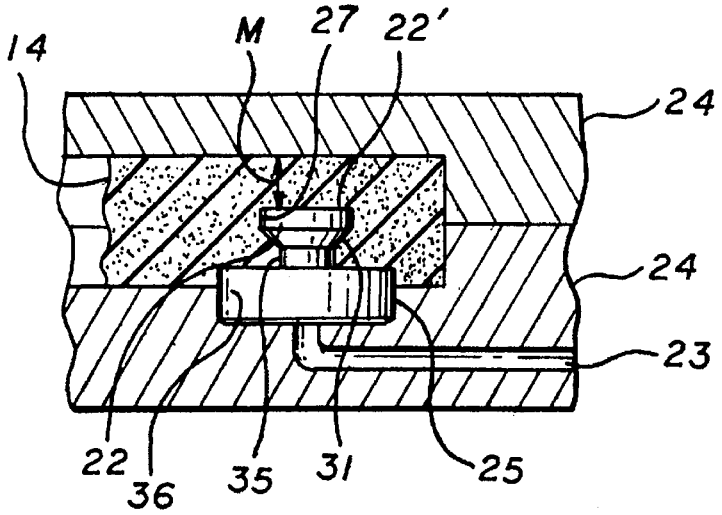
FIG. 11 is a partial cross-sectional view through a wear boss, associated midsole component, and forming mold, similar to that seen in FIG. 8, except that the upper portion of the wear boss, including the rivet head, is shown formed into a blind opening pre-formed into the midsole portion.

Referring to FIGS. 11–14, alternative embodiments of the sole component and production method are illustrated. In FIG. 11, a process for forming/attaching a boss 18 on the midsole 14 is illustrated in which the rivet structure of the boss does not extend completely through the midsole 14, i.e., a "blind" attachment process. Specifically, the midsole 14 is previously formed using known techniques (preferably from foamed EVA), to include therein a "blind" cavity 36, i.e., the cavity 36 does not extend completely through the midsole 14. The midsole 14 is then placed in the second mold set 24 and compression pressure is applied, as in the previous embodiments. Outsole material is then injected into the cavity 36 by way of a gate 23 formed in the mold 24. The support member 29 of the boss 18 is formed between the midsole 14 and the lower half of the mold 24 using a recess 25 formed in the lower surface of the mold 24, as in the previously discussed embodiments. The injected rubber outsole material cures in the mold 24, and, as discussed above, boss 18 will be subjected to a slight contraction upon the curing of the outsole material. When the compression pressure is removed by the mold 24, the midsole material 14 expands, forming a secure fit between the boss 18 and the midsole 14.

As with the embodiment shown in FIG. 7, the cavity 36 formed in the midsole 14 shown in FIG. 11 includes the "negative," or mold, of a "rivet-like" structure having a flat rivet head surface 22' to form a flat upper surface 19 of a "positive" rivet head, a side wall surface 27 to form rivet head rim 52, a chamfered edge 31 to form the chamfered surface 30 on the rivet head 22, and a flat side surface 35 to form the shaft 28. As seen in FIG. 11, the shaft 28 of the rivet structure in this embodiment will be substantially shorter than the shaft in the embodiment shown in FIG. 7. As such, the rivet head 22 of the boss 18 will be positioned in the middle of the midsole material 14.

One advantage of the embodiment seen in FIG. 11 is the comfort associated with the provision of a thickness, or layer, of midsole M material above the upper surface of the rivet head 22 of the boss 18. The embodiments shown in FIGS. 4–10 do not provide for a layer of midsole material over the upper surface 22 of the boss 18. As such, depending on the placement of the bosses 18 within the midsole 14, an individual may be able to detect the presence of the localized individual bosses 18 in the midsole material while wearing the shoe, since the durometer of the boss material is typically higher than that of the midsole material. Forming the "blind" rivet structures of the bosses 18 within the midsole material 14, as seen in FIG. 11, such that the layer M of the midsole material 14 overlays the rivet head 22, renders it more unlikely that a wearer will detect the localized presence of the individualized bosses 18 in the midsole. Further, those skilled in the art will appreciate that most modern footwear includes an "insole," i.e., a layer of material formed of rubber, nylon, terry cloth or other suitable material positioned above the midsole 14. This additional layer of cushioning, which is often formed to cover the entire interior footbed surface in a shoe, additionally reduces the possibility that a wearer will detect bosses 18 in a sole formed in accordance with the present invention.

Skilled practitioners of the molding art will recognize that a potential drawback associated with the embodiment seen in FIG. 11 is that the reliable formation of the "blind" rivet head 22 structures is relatively more difficult to achieve because the cavity, or negative "mold" 36, for the rivet head 22 structure in the midsole is not vented to permit the air in the cavity to escape due to the infusion of the boss material into the cavity during molding. However, this problem can be easily overcome using readily known molding techniques, e.g., by providing a small, local vent tube, either in the upper half of the mold 24, or molded into the midsole 14 itself, that extends through the midsole 14 and into the cavity 36, or alternatively, by applying a vacuum to the mold 24 through the injection gate 23 immediately prior to injection of the liquid boss-forming material. Centrifugal casting techniques, such as those described in U.S. Pat. Nos. 4,855,096 and 4,943,223 to Panaroni, provide another means for avoiding this potential problem.

Figure 12:
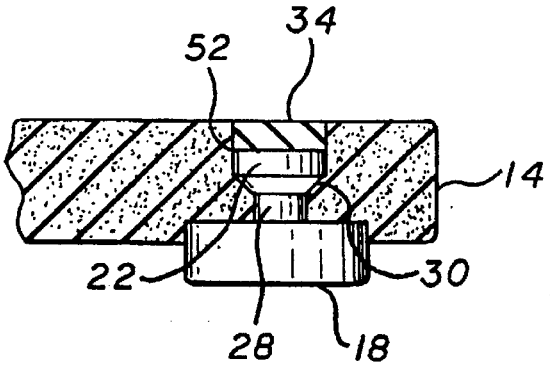
FIG. 12 is a partial cross section taken through a wear boss and associated midsole component of the present invention wherein the countersink formed in the midsole portion is shown recessed below the upper surface of the midsole portion, and wherein the resulting recess between the top of the rivet head on the wear boss and the upper surface of the midsole portion is shown filled with a plug of midsole material.

An alternative method for achieving a "blind" wear boss 18, i.e., one having a rivet structure disposed within the thickness of the midsole 14, can be seen in FIG. 12. In this embodiment, the wear boss 18 is positioned within the midsole material 14 at a position substantially similar to that shown in FIG. 11. However, in FIG. 12, the cavity 36 is formed to extend completely through the midsole 14, as in the first embodiment described above, with the flat rivet head 22 being countersunk a predetermined distance into the midsole 14.

In this embodiment, the countersink 50 is pre-molded into the midsole 14 at the time of the latter's formation, and is then partially occupied by an appropriately-shaped protuberance (not shown) on the upper half of the second mold 24 to define, between itself and the midsole, the complementary, negative mold of the rivet head. A separate "cover plug" 34 is formed, e.g., by die-cutting, of the same material as the midsole 14, and is placed in the countersink 50 over the flat upper surface of the rivet head 22 of the boss 18. The cover plug 34 may also be molded in a separate mold (not shown) and then adhered to the flat upper surface 22 using a suitable adhesive, or may be held in place by means of an overlying insole. Alternatively, the cover plug 34 may also be formed by completing a separate injection step to inject a sufficient amount of midsole material into the countersink 50 after formation of the boss 18. As with the embodiment of FIG. 11, the embodiment shown in FIG. 12, including the countersink 50 and cover plug 34, also provides for an additional level of comfort by reducing any contact between the rivet head 22 and the bottom of the wearer's foot.

Figure 13:
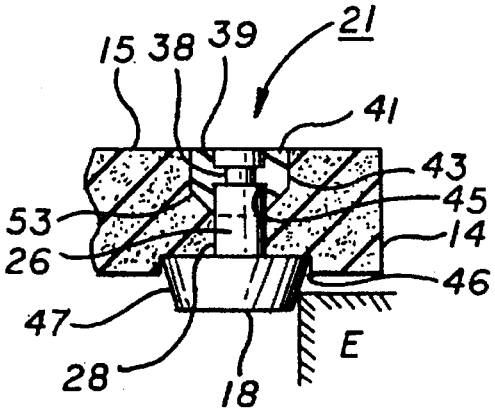
FIG. 13 is a partial cross section taken through an alternative embodiment of a wear boss and associated midsole component of the present invention wherein the rivet head is formed or installed on the upper end of the upper portion of the wear boss after the upper portion of the wear boss is manually inserted into the opening in the midsole; and, FIG. 14 is a partial cross section taken through yet another alternative embodiment of a wear boss and associated midsole component of the present invention wherein the rivet head is mechanically installed onto the upper end of the upper portion of the wear boss after the upper portion of the wear boss is manually inserted into the opening in the midsole.

FIG. 13 illustrates yet another alternative method for mechanically joining wear bosses 18 to the midsole 14 without use of adhesives. The bosses 18 are formed in a molding operation separate from that used to form the midsole 14. The midsole is formed with through openings 26 for receiving the bosses 18 in the manner described above in conjunction with FIGS. 7–10. The rivet structures 21 of the bosses 18 are formed without heads, and in their stead, are provided with a separate, smaller shaft 38 that extends from the upper end of the shaft 28. A flat head 39 is molded atop the smaller shaft 38 to define a small, annular recess 45 between the head 39 and the shaft 28.

In this embodiment, the bosses 18 are manually inserted into the openings 26 formed in the midsole 14, and then, in a separate molding operation carried out in a second mold set (not illustrated), an additional portion 41 of liquid boss material is injected into the upper portion 43 of the opening 26 about the shaft 28 of the boss 18 previously inserted therein. As with the previous embodiments, a slight compression force is preferably applied to the midsole 14 during this second molding operation.

As seen in FIG. 13, the recess 45 receives the potion 41 of the liquid boss material, which is injected into the upper portion 43 of the through openings 16 and onto the upper end of the shaft 28. When the additional boss material 41 cures, it forms an interlocking, mechanical grip on the upper end of the rivet shaft 28, i.e., a "molded-in-place" rivet head 39 is formed on the upper end of the shaft 18 that prevents the boss 18 from being slidably removed from the midsole 14.

Skilled practioners may also recognize, in connection with the embodiment illustrated in FIG. 13, that it possible to mold the rivet head 39 in a separate molding operation, apart from the midsole, as a separate, distinct mechanical fastener piece. In this variant, it is desirable to form the piece to include some means for permitting it to expand circumferentially, so that it can be forced down over the upper end of the shaft 28 and engage the recess 45 thereon. To that end, the rivet head 39 can be molded to incorporate a longitudinal slot extending through a substantial portion of its length or alternatively, the slot can be cut into the piece after molding. The slot permits the annular rivet head 39 to expand circumferentially so that the piece can be snapped down over the upper end of the rivet shaft 28, then to contract into mechanical engagement with the recess 45 in an over-center, locking arrangement, thereby securing it to the shaft, and thus, the boss 18 to the midsole 14.

FIG. 13 best illustrates another feature of the present invention. It may be noted that, in this and in the other figures, the upper surface of the lower portion of the boss 18 is recessed slightly above the lower surface 20 of the midsole. To this end, it is desirable that a recess 46 be molded into the midsole at the time that it is formed. The recess serves both to position the boss 18 appropriately on the midsole 14, and to shield the interface between the boss and the midsole lower surface 20 against penetration by foreign objects, such as the edge E seen in FIG. 13, which could wedge between the two surfaces and either tear the boss from the midsole, or trip the wearer, or both. To this end, it is also preferable to provide a taper on the sidewalls 47 of the lower portion of the boss 18, such as that illustrated in FIG. 13, so that a lateral impact of the boss 18 with such an object has the tendency to deflect the boss from the object, rather than to permit the object to penetrate between these surfaces.

Figure 14:
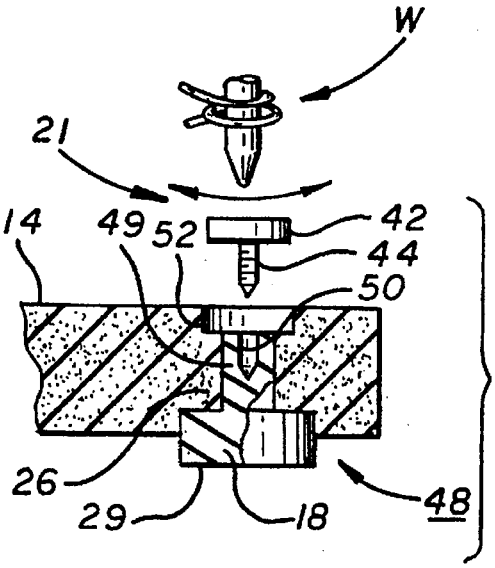

Referring to FIG. 14, yet another alternative rivet structure 21 is shown. More specifically, in this embodiment, the bosses 18 are formed in two pieces. A lower boss member 48 includes a lower support member 29 and a shaft 49 that are substantially similar to those in the above-discussed embodiments. However, a separate upper rivet head 42 is provided that includes a ribbed shaft 44. The shaft 49 of the boss 18 is formed to include a counterbore 50 in an upper end thereof to accommodate the shaft 44, but the counterbore 50 is sized to be slightly smaller in diameter than the diameter of the shaft 44. The shaft 44 is preferably cyclically shaped, but may be any suitable shape, including, but not limited to, rectangular, triangular, or conical. The lower boss member 48 is formed of injection molded rubber, PU, or other suitable plastic or nylon material, while the upper rivet head 42, including the ribbed shaft 44, is formed of metal, preferably aluminum.

In this embodiment, the lower boss member 48 may be formed in the manner discussed above in conjunction with FIG. 12, in which a second mold 24 is used to slightly compress the midsole 14 while the lower boss member 48, including the shaft 49, are being formed therein. In this situation, the mold used to form the lower boss member 48 would include a recess to shape the lower support member 29, and a protuberance shaped to form the upper surface of the shaft 48, including the counterbore 50 between themselves and the pre-formed midsole. Alternatively, the lower boss member 48 can be formed separate from the midsole 14, and be manually inserted therein in the manner described in conjunction with FIG. 13.

As in the embodiment shown in FIG. 12, a counterbore 52 is formed to receive the rivet head 42. After the lower boss member 48 is formed or inserted in the midsole 14, the rivet head 42 is positioned over the countersink 52, and the fibbed shaft 44 is pushed into the counterbore 50 formed in the upper surface of shaft 48. An ultrasonically vibrating welding head W is then brought into contact with the upper surface of the rivet head 42 to apply a downward pressure on it, and simultaneously, is activated to "scrub" the upper surface of the rivet head 42 back and forth, as shown by the arrows in FIG. 13, at ultrasonic frequencies, thereby causing the aluminum metal of the rivet head 41 and ribbed shaft 44 to heat up. The heat generated in this step causes the ribbed shaft 44 to melt its way into the counterbore 50 in shaft 49. The metal of the rivet head 42 then cools, and the ribbed shaft 44 is left disposed securely in the shaft 48, with the material of shaft 49 melted about the circumference of the ribbed shaft 44. The ribs formed on the shaft 44 prevent the shaft 44 from being pulled out of engagement with the shaft 49. In this fashion, the rivet head 42 is secured to the lower boss member 48.

Skilled practitioners may recognize that, at least in those sole components that use a molded midsole 14, as opposed to a thermoformed midsole, the methods described above can be reversed to achieve substantially similar results. That is, it is possible, and in some cases may be more desirable, to mold one or more bosses 18 from an appropriate material in a first set of boss molds, the bosses including the desired rivet features described above, then to place the bosses in an appropriately configured second mold, and then inject a suitable midsole material therein to form the midsole over the bosses. In this fashion, the midsole material will flow around the rivet features on the bosses, and when cured, will mechanically secure the bosses to the midsole in the same manner as described above. The key is to use the first-molded sole component in conjunction with the second mold to form the desired attachment features in, or on, the second-molded component.

The above-discussed preferred embodiments of the present invention allow for the formation of a sole structure that includes discrete wear plugs or bosses 18 at desired locations on the ground-facing surface of a shoe, while avoiding an outsole component that covers substantially the entire bottom surface of the midsole. In so doing, the present invention reduces the amount of material needed for the outsole. A corresponding weight savings is thus obtained in the finished shoe, in addition to savings in material costs for the outsole component. By eliminating the webbing between the outsole wear boss components typical of prior art outsole construction, it is possible to achieve as much as a 10–20% weight savings in the finished footwear made in accordance with the present the present invention. Further, a shoe sole made in accordance with the above-discussed invention avoids the adhesive attachment expense and problems of the prior art sole components described above.

Of course, skilled practitioners of the art of footwear construction will readily appreciate that numerous modifications and/or substitutions can be made to the disclosed preferred embodiments described hereinabove, in terms of their materials, structures, processes and the like. For example, wear bosses having structures that differ from the "rivet-like" structures described herein could be formed. Similarly, other plastic or rubber materials could be substituted for those described in the exemplary midsole and outsole described above. It is the inventor's intention that all such modifications, substitutions, and additions to the invention disclosed herein fall within the scope of the present invention, which is best defined by the claims appended hereinafter.

What is claimed is:

1. An improved article of footwear of the type having a sole component in combination with an upper, in which the sole component is permanently secured to the upper, and in which the sole component includes a midsole portion and an outsole portion, wherein the improvement comprises:

the midsole portion having an upper, footbed-defining surface, a lower, ground-directed surface, and at least one opening extending into it through its lower surface;

the outsole portion disposed on the midsole portion such that the outsole portion has a lower part defining a ground-contacting wear-boss depending from the lower surface of the midsole portion, and an upper part extending into the opening in the midsole portion; and, means for forming a substantially permanent, non-adhesive mechanical attachment between the outsole portion and the midsole portion on an upper end of the upper part of the outsole portion.

2. The article of footwear of claim 1, wherein the opening in the midsole component further includes a countersink in an upper region thereof, and wherein the mechanical attachment means further comprise a head formed on the upper end of the upper part of the outsole portion within the countersink.

3. The article of footwear of claim 2, wherein the opening in the midsole portion extends through the upper surface thereof, and wherein the countersink is disposed below the upper surface of the midsole portion.

4. The article of footwear of claim 2, wherein the opening in the midsole portion extends through the upper surface thereof, and wherein the countersink is formed in the upper surface of the midsole portion.

5. The article of footwear of claim 1, wherein the opening in the midsole component further includes a countersink formed in an upper region thereof, and wherein the mechanical attachment means further comprises a head attached to the upper end of the upper part of the outsole portion within the countersink.

6. The article of footwear of claim 5, wherein the opening in the midsole portion extends through the upper surface thereof, and wherein the countersink is disposed below the upper surface of the midsole portion.

7. The article of footwear of claim 5, wherein the opening in the midsole portion extends through the upper surface thereof, and wherein the countersink is formed in the upper surface of the midsole portion.

8. The article of footwear of claim 1, wherein the midsole portion is formed of at least one of the following materials: ethylene vinyl acetate and polyurethane.

9. The article of footwear of claim 1, wherein the midsole portion further includes an outsole-portion-receiving recess in the lower, ground-contacting surface thereof, such that, when the outsole portion is attached to the midsole portion, an upper surface of the lower part of the outsole portion is recessed above the lower surface of the midsole portion.

* * * * *